United States Patent [19]

Newman

[11] Patent Number: 4,940,436

[45] Date of Patent: Jul. 10, 1990

[54] MARINE DRIVE SYSTEM WITH INBOARD MOUNTED ENGINE AND DEPENDING DRIVE UNIT

[75] Inventor: Neil A. Newman, Omro, Wis.

[73] Assignee: Brunswick Corporation, Skokie, Ill.

[21] Appl. No.: 251,104

[22] Filed: Sep. 28, 1988

[51] Int. Cl.[5] ..... B63H 23/36

[52] U.S. Cl. ..... 440/112; 440/69

[58] Field of Search ..... 440/49, 51, 53, 55-70, 440/112; 114/288, 290

[56] References Cited

U.S. PATENT DOCUMENTS

| | | | |
|---|---|---|---|
| 2,946,306 | 7/1960 | Leipert | 440/62 |
| 3,396,692 | 8/1968 | Bergstedt | 440/62 |
| 3,404,656 | 10/1968 | Chamberlain | 440/62 |
| 3,489,120 | 1/1970 | Strang | 440/63 |
| 3,626,894 | 12/1971 | Stuart | 440/69 |
| 3,937,173 | 2/1976 | Stuart | 440/69 |
| 4,015,556 | 4/1977 | Bordiga | 440/69 |

FOREIGN PATENT DOCUMENTS

| | | | |
|---|---|---|---|
| 1112421 | 8/1961 | Fed. Rep. of Germany | 440/69 |

*Primary Examiner*—Joseph F. Peters, Jr.

*Assistant Examiner*—Jesus D. Sotelo

*Attorney, Agent, or Firm*—Andrus, Sceales, Starke & Sawall

[57] ABSTRACT

A marine drive system includes one or more engines mounted inboard of a boat adjacent the boat transom. The one or more engines are disposed such that their longitudinal axes are substantially perpendicular to the boat centerline and parallel to the boat transom. A drive unit extends substantially vertically relative to each engine during operation. The drive unit preferably includes a drive housing which is mounted to the boat so as to be pivotable between an operating position, in which the propeller is submerged, and an inoperative position in which the propeller is out of the water and the drive unit is disposed at an angle to the vertical relative to the engine. The construction provided by the engine is advantageously employed in a boat hull design in which a pocket is formed in the boat hull, and a portion of the propeller path is disposed within the pocket. With the transverse placement of the engines, the pockets in the boat hull can extend from the front to the rear of the boat hull, and do not require modification to accommodate placement of the engine.

14 Claims, 2 Drawing Sheets

FIG. 1
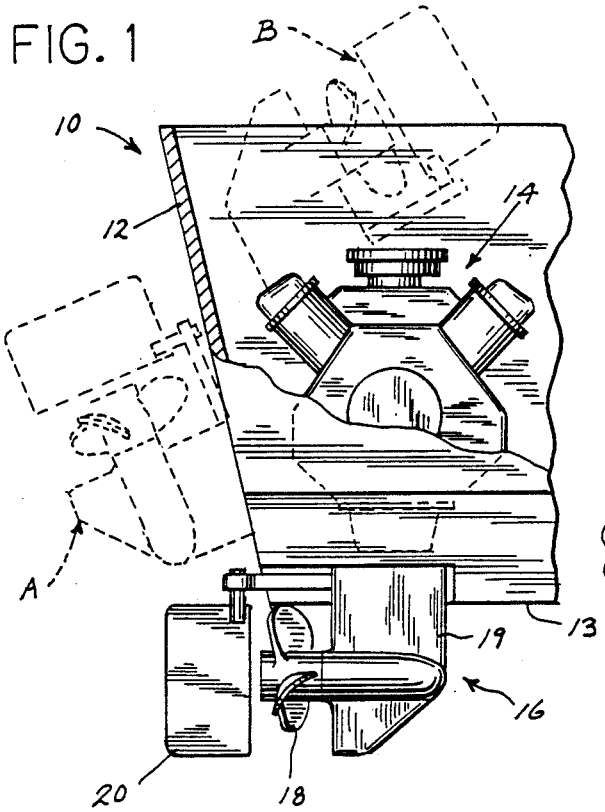
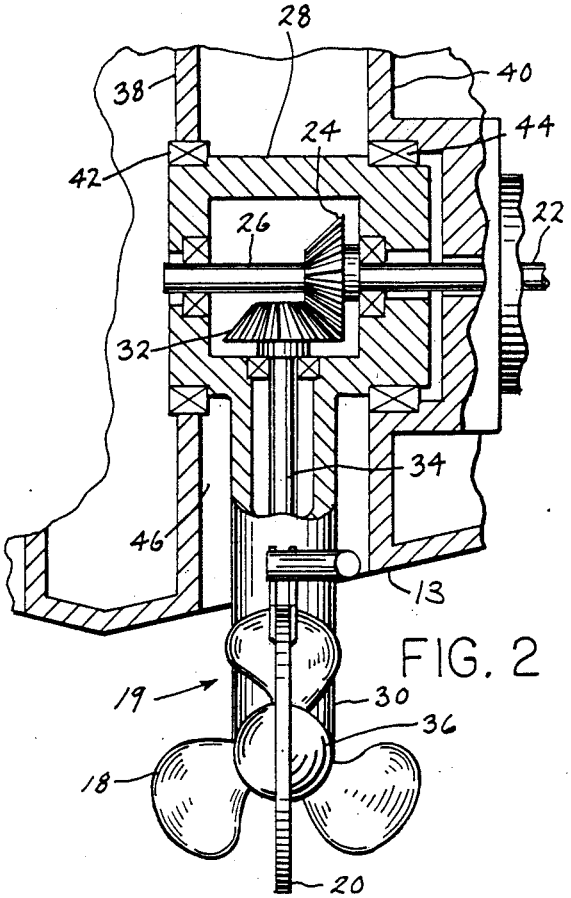
FIG. 2
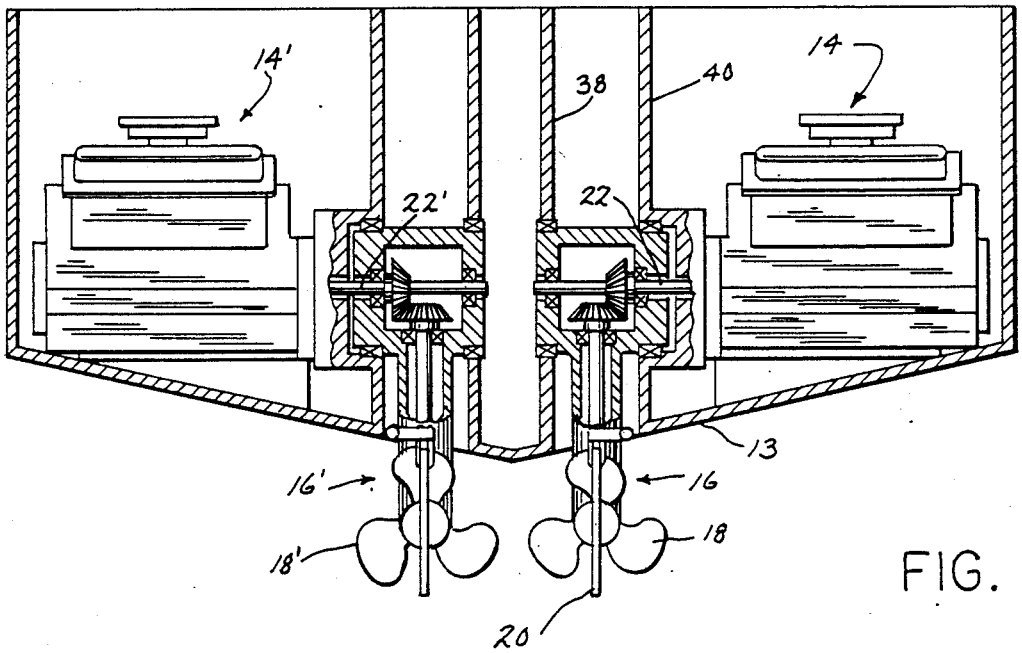
FIG. 3

FIG. 4
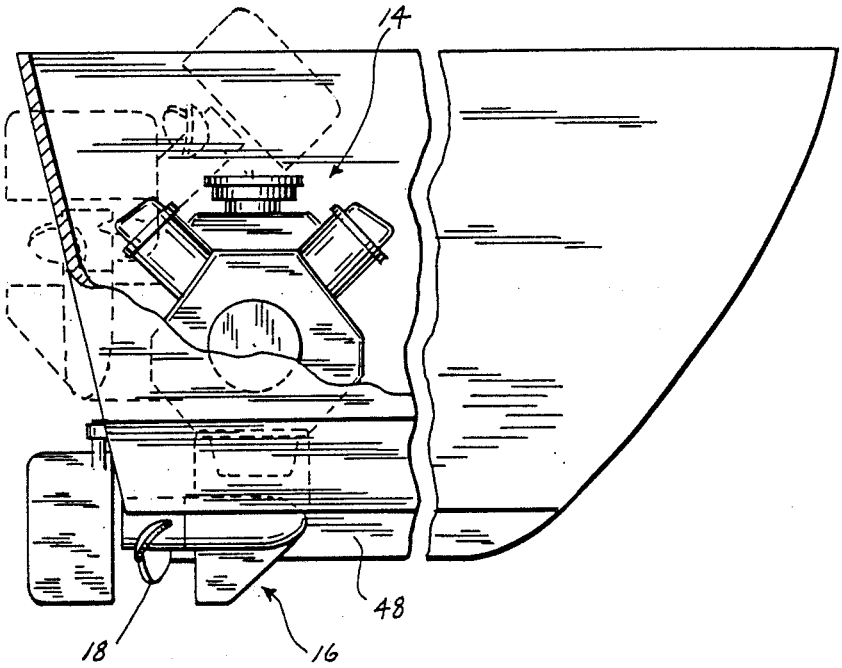
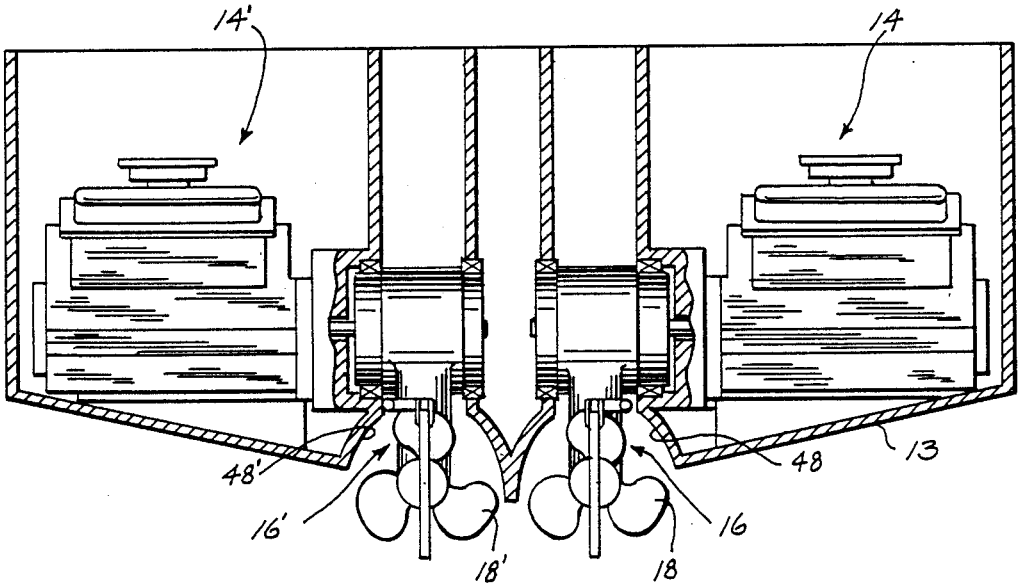
FIG. 5

MARINE DRIVE SYSTEM WITH INBOARD MOUNTED ENGINE AND DEPENDING DRIVE UNIT

BACKGROUND AND SUMMARY

This invention relates to a marine propulsion system, and more particulary to such a system in which the engine is mounted in the interior of a boat.

A typical engine employed in a marine propulsion system is substantially longer than it is wide. When such an engine is mounted within the interior of a boat, the engine necessarily encroaches on usable space within the boat. Accordingly, there is a need for an arrangement in which the space occupied in the interior of the boat by the engine is reduced.

Further, it has been found that an inboard/outboard stern drive system is generally unsatisfactory when used on a large hull boat due to corrosion caused by salt water in which such boats are normally operated. There is thus a further need for a system in which the drive unit in such an installation can be fully retracted out of the water during periods of nonuse.

To address the above-mentioned problems, the invention provides an engine placement configuration in which the engine is placed within the interior of the boat so that its longitudinal axis extends substantially parallel to the boat transom. With such transverse placement of the engine, the usable space occupied in the interior of the boat by the engine is reduced over that resulting from in-line placement of the engine. The invention also provides a drive unit having a drive housing which extends substantially vertically relative to the engine during operation. When desired, the engine can be placed adjacent one side of the boat with the engine output shaft extending toward the center of the boat. A second engine is then placed adjacent the other side of the boat. The output shaft of the second engine also extends toward the center of the boat, and the drive units interconnected with the output shafts of the engines are disposed one on either side of the boat centerline. In a preferred application, the drive units are relatively close together, thus improving boat performance and handling.

With the transverse placement of the engines, a boat hull design including an axially extending pocket can advantageously be employed. As is known, placement of all or part of the propeller path into such a pocket formed in the boat hull provides relatively obstruction free operation of the propeller. The pocket formed in the boat hull typically extends substantially parallel to the boat centerline. In a usual installation in which the inboard mounted engine is mounted at the boat centerline and is in line with the propeller, the pocket formed in the boat hull is designed such that the entrance into the pocket is disposed rearwardly of the drive components. Such a design is exemplarily shown in U.S. Pat. No. 4,015,556 to Bordiga. Too steep an entrance into the pocket results in unsatisfactory flow of water therethrough. Accordingly, it is advantageous to design the pocket such that the pocket entrance is relatively gradual. One solution to this problem is to place the engine further forward in the boat interior than usual, resulting in a more gradual entrance into the hull pocket. However, such engine placement encroaches on the usable space in the forward portion of the boat compartment. With the transverse placement of the engine according to the invention, the hull pocket can extend throughout the entire length of the boat hull, so that the entrance into the pocket is at the front of the boat. Such a pocket design results in improved boat operation by providing highly satisfactory flow of water through the pocket and into the path of the propeller. In a dual engine installation, a pair of parallel pockets can be formed in the boat hull extending throughout the entire length of the hull.

The invention further provides a mechanism for lifting the drive components of the drive unit out of the water during periods of nonuse, or when the propeller needs maintenance or inspection. With the transverse placement of the engine at the rear of the boat, the engine output shaft extends substantially parallel to the boat transom. The output shaft preferably forms a pivot axis about which the drive unit is pivotable between a first position, in which the drive unit extends substantially vertically relative to the engine and the propeller is submerged, and a second position in which the propeller is out of the water and the drive unit extends at an angle to the vertical relative to the engine. The drive unit is preferably movable so that it can be positioned completely out of the water and stowed in such a position until needed for use. Steering can be provided either by positioning a rudder aft of the propeller, or by employing a steerable gearcase.

BRIEF DESCRIPTION OF THE DRAWINGS

The drawings illustrate the best mode presently contemplated of carrying out the invention.

In the drawings:

FIG. 1 is a partial elevation view, partially in section, showing the transverse mounted inboard engine and depending drive unit of the invention;

FIG. 2 is an enlarged rear elevation view, partially in section, of the drive unit of FIG. 1;

FIG. 3 is a rear elevation view, partially in section, showing a pair of transverse mounted inboard engines and depending drive units;

FIG. 4 is a view similar to FIG. 1, showing the drive unit of the invention in which the propeller is disposed within a pocket formed in the hull of the boat; and FIG. 5 is a rear elevation view similar to FIG. 3, showing a pair of transverse mounted inboard engines and depending drive units in which the propellers are mounted such that a substantial portion of the path of each propeller is disposed within a pocket formed in the boat hull.

DETAILED DESCRIPTION OF THE PREFERRED EMBODIMENT

With reference to FIG. 1, a boat 10 includes a transom 12 and a hull 13, and an internal combustion engine 14 of conventional construction is mounted in the interior of boat 10 adjacent transom 12. A drive unit, shown at 16, is drivingly interconnected with engine 14. Drive unit 16 includes a rotatably mounted propeller 18, and a rudder 20 is disposed aft of propeller 18 for providing steering. As shown, drive unit 16 includes a drive housing 19 which extends downwardly substantially vertically relative to engine 14. Drive unit 16 is mounted to boat 10 so as to be movable between a first operating position, shown by the solid lines of FIG. 1 in which propeller 18 is submerged during operation and drive housing 18 extends substantially vertically relative to engine 14, and one or more second positions in which propeller 18 is positioned out of the water and drive housing 18 extends at an angle to the vertical relative to engine 14. Such second positions for drive unit 16 are shown in phantom in FIG. 1, and are denominated A and B.

The longitudinal axis of engine 14 is disposed substantially parallel to boat transom 12. With this arrangement, the usable space occupied in the interior of boat 10 by engine 14 is substantially reduced over a conventional arrangement in which the longitudinal axis of engine 14 extends along the boat centerline.

With reference to FIG. 2, an output shaft 22 is drivingly interconnected with engine 14 so as to be rotatable in response thereto. Output shaft 22 extends along a common axis relative to the crankshaft of engine 14, and is interconnected therewith. Output shaft 22 has a bevel gear 24 mounted thereto, and a supporting projecting portion 26. Drive housing 19 includes an upper gear housing portion 28, within which bevel gear 24 and projecting portion 26 are rotatably mounted, and a lower portion 30 depending therefrom. As shown, upper gear housing portion 28 houses an upper bevel gear 32 connected to the upper end of downwardly extending drive shaft 34, which is connected through appropriate gearing located in lower portion 30 of drive housing 19 with propeller 18. With this construction, propeller 18 is rotatable in response to rotation of engine output shaft 22. As is known, a satisfactory reversing transmission is located in the torpedo 36 formed in lower portion 30 of drive housing 19.

As shown, upper gear housing portion 28 of drive housing 19 is mounted to a pair of structural ribs 38, 40 provided within the interior of boat 10. A pair of bearings, shown at 42, 44, are disposed between upper gear housing portion 28 of drive housing 19 and ribs 38, 40, so as to provide pivoting movement of upper gear housing portion 28 of drive housing 19 therein. With this construction, the pivot axis about which drive housing 19 is pivotable is defined by output shaft 22. Satisfactory means is provided for moving drive unit 16 between its pivoting positions as shown in FIG. 1, for example a tilt cylinder or the like. Alternatively, drive unit 16 can be manually pivoted to its various positions.

The portion of drive housing 19 projecting downwardly from upper gear housing portion 28 extends through a substantially vertical channel 46 formed in boat hull 13 between ribs 38, 40. Provision of channel 46 accommodates movement of drive unit 16 to its pivoted positions.

As shown in FIG. 3, engine 14 is positioned adjacent the starboard side of boat 10, such that engine output shaft 22 extends toward the centerline of boat 10. A second engine, shown at 14', is located adjacent the port side of boat 10 with an engine output shaft 22' extending toward the centerline of boat 10. A drive unit, shown at 16' and having a propeller 18', is drivingly interconnected with engine output shaft 22' in a manner similar to that detailed above with respect to engine 14. Such placement of engines 14, 14' allows propellers 18, 18' to be located relatively closely adjacent the centerline of boat 10. With this arrangement, boat performance and handling is improved in a dual engine installation. As detailed above, drive unit 16' is pivotable about an axis defined by engine output shaft 22' to a series of positions in which drive unit 16' is disposed such that propeller 18' is out of the water and drive unit 16' is at an angle to the vertical relative to engine 14'.

As shown in FIG. 4, a pocket 48 is formed in boat hull 13. Pocket 48 extends substantially the entire length of boat hull 13 from front to rear, such that the entrance into pocket 48 is at the same elevation as the exit from pocket 48. Propeller 18 has at least a portion of its path disposed within pocket 48, so as to provide relatively obstruction free operation. With pocket 48 extending throughout the length of boat hull 13 and the entrance and exit of water to and from pocket 48 at the same elevation, a highly satisfactory flow of water is provided through pocket 48 and into the path of propeller 18. In previous pocketed hull configurations, when engine 14 is positioned such that its axis is aligned with the boat centerline, the entrance into the pocket is disposed rearwardly of the forward end of the boat hull, providing a curved entrance into the pocket. With the arrangement shown in FIG. 4, however, it is possible to extend pocket 48 throughout the entire length of boat hull 13, thus providing better flow of water through the boat hull pocket and into the path of the propeller.

As shown in FIG. 5, a second pocket, shown at 48', is provided on the other side of the centerline of boat 10 from pocket 48, and a portion of the path of propeller 18' is disposed therein. As shown, approximately half of the path of propellers 18, 18' is located within pockets 48, 48' during operation of propellers 18, 18'. Again, the construction of drive housings 16, 16' is similar to that detailed above, so that drive housings 16, 16' can be pivoted about axes defined by engine output shafts 22, 22' so as to lift propellers 18, 18' out of the water when necessary or desired.

Various alternatives and modifications are contemplated as being within the scope of the following claims particularly pointing out and distinctly claiming the invention.

I claim:

1. A marine drive for a boat, comprising:

an engine drivingly interconnected with an axially extending rotatable output shaft, said engine being located in the interior of said boat adjacent the boat transom; and a drive unit drivingly interconnected with said output shaft and including a drive housing having a propeller rotatably mounted thereto, said drive unit including drive means for drivingly interconnecting said output shaft and said propeller, said drive housing being mounted to said boat so as to be pivotable about a pivot axis through a range of positions including a first position in which said propeller is submerged during boat operation with said drive unit extending substantially vertically relative to said engine, a second position in which said propeller is positioned out of the water and said drive unit is disposed at an angle to the vertical relative to said engine, and a third position in which said drive unit is positioned out of the water;

wherein said drive housing includes a longitudinally extending portion within which is disposed said drive means interconnected with a propeller shaft to which said propeller is mounted, and wherein said drive housing in its third position is positioned such that the longitudinal axis of the longitudinally extending portion of said drive housing is rotationally above a horizontal plane through the pivot axis of said drive housing; and wherein said output shaft and the crankshaft of said engine extend along a common axis and extend substantially parallel to the boat transom, and wherein said output shaft defines the pivot axis about which said drive housing is pivotable.

2. A marine drive for a boat, comprising:

a pair of engines located in the interior of the boat adjacent the boat transom, each said engine being drivingly interconnected with a rotatable output shaft adapted to be driven by the respective engine crankshafts, each said output shaft extending substantially parallel to the boat transom; and a pair of drive units drivingly interconnected with said rotatable output shafts, each said drive unit including a drive housing having a propeller rotatably mounted thereto, each said drive housing being mounted to said boat so as to be pivotable between a first position in which the propeller mounted to said drive housing is submerged during boat operation, with said drive unit extending substantially vertically relative to said engine, and a second position in which said propeller is positioned out of the water and said drive unit is disposed at an angle to the vertical relative to said engine, each said drive housing being pivotable about an axis defined by the respective output shaft with which the respective drive unit is drivingly interconnected.

3. The marine drive according to claim 2, wherein each said output shaft is aligned with the crankshaft of the engine to which the output shaft is connected, and wherein said output shafts are substantially aligned with each other.

4. The marine drive according to claim 3, wherein one of said engines is positioned adjacent the starboard side of said boat and the other of said engines is positioned adjacent the port side of said boat, and wherein each said output shaft extends from the respective engine to which it is connected toward the center of said boat.

5. The marine drive according to claim 4, wherein said propellers are positioned one on each side of the boat centerline, and are closely spaced to each other.

6. The marine drive according to claim 3, wherein each said engine is oriented such that its longitudinal axis extends substantially parallel to the boat transom.

7. A watercraft assembly, comprising:

a boat having a hull including an axially extending pocket oriented substantially parallel to the boat centerline;

an engine mounted in the interior of said boat adjacent the boat transom;

a rotatable output shaft drivingly connected to said engine; and a drive unit, including:

a drive housing;

a propeller rotatably mounted to said drive housing; and drive means for drivingly interconnecting said propeller and said rotatable output shaft for driving said propeller in response to rotation of said output shaft;

said drive housing being located toward the rear of said boat adjacent the boat transom and having an upper portion disposed within the interior of said boat and a depending lower portion to which said propeller is mounted;

the lower portion of said drive housing being oriented such that a portion of the path of said propeller is disposed within said axially extending pocket; and wherein said drive housing is mounted to said boat so as to be movable between a first position in which said drive unit extends substantially vertically relative to said engine with said propeller disposed within said pocket, and a second position in which said drive unit is disposed at an angle to the vertical relative to said engine with said propeller positioned out of the water.

8. The watercraft assembly according to claim 7, wherein said drive housing is mounted to said boat so as to be pivotable between said first and second positions.

9. The watercraft assembly according to claim 8, wherein said rotatable output shaft extends substantially parallel to the boat transom and defines the axis about which said drive housing is pivotable.

10. The watercraft assembly according to claim 9, wherein said engine is mounted within said boat such that its longitudinal axis is substantially parallel to the boat transom, and wherein the crankshaft of said engine and said output shaft extend along a common axis.

11. The watercraft assembly according to claim 7, wherein said axially extending pocket extends throughout the length of said boat hull, with the entrance to said pocket being at substantially the same elevation as the exit from said pocket, so as to provide satisfactory flow of water through said pocket and into the path of said propeller.

12. A watercraft assembly, comprising:

a boat having a hull including an axially extending pocket oriented substantially parallel to the boat centerline;

an engine mounted in the interior of said boat adjacent the boat transom;

a rotatable output shaft drivingly connected to said engine; and a drive unit, including:

a drive housing;

a propeller rotatably mounted to said drive housing; and drive means for drivingly interconnecting said propeller and said rotatable output shaft for driving said propeller in response to rotation of said output shaft;

said drive housing being located toward the rear of said boat adjacent the boat transom and having an upper portion disposed within the interior of said boat and a depending lower portion to which said propeller is mounted;

the lower portion of said drive housing being oriented such that a portion of the path of said propeller is disposed within said axially extending pocket; and wherein said engine is mounted adjacent a side of said boat with said output shaft extending toward the center of said boat;

a second engine disposed adjacent the other side of said boat;

a second output shaft interconnected with said second engine and extending toward the center of said boat; and a second drive unit substantially identical to said first-mentioned drive unit;

said boat hull including a second axially extending pocket substantially parallel to said first-mentioned pocket, with the propeller of said second drive unit being disposed within said second pocket, said drive units being closely spaced to each other and arranged one on either side of the centerline of said boat.

13. The watercraft assembly according to claim 12, wherein said drive units are both movable between a first position in which said drive units extend substantially vertically relative to said engines with said propellers submerged, and a second position in which said propellers are out of the water and said drive units are disposed at an angle to the vertical relative to said engines.

14. The watercraft assembly according to claim 13, wherein each said drive unit is mounted to said boat so as to be pivotable between said first position and said second position about a pivot axis defined by the output shaft to which said drive unit is drivingly interconnected.

* * * * *